US005449166A

United States Patent [19]

Lohmann et al.

[11] Patent Number: 5,449,166

[45] Date of Patent: Sep. 12, 1995

[54] APPARATUS FOR REVERSING THE DIRECTION OF FLAT ITEMS

[75] Inventors: Boris Lohmann, Allensbach; Werner Frank, Reichenau; Armin Zimmermann, Konstanz, all of Germany

[73] Assignee: Licentia Patent-Verwaltungs-GmbH, Frankfurt am Main, Germany

[21] Appl. No.: 238,939

[22] Filed: May 6, 1994

[30] Foreign Application Priority Data

May 6, 1993 [DE] Germany ..... 43 15 053.5

[51] Int. Cl.[6] ..... B65H 5/00

[52] U.S. Cl. ..... 271/225; 271/270; 271/185; 271/186; 271/202; 271/902; 271/265.02

[58] Field of Search ..... 271/225, 265, 277, 275, 271/270, 288, 291, 297, 305, 184–186, 176, 199, 202, 203, 902

[56] References Cited

U.S. PATENT DOCUMENTS

| | | | |
|---|---|---|---|
| 3,273,886 | 9/1966 | Taylor, Jr. . | |
| 3,391,777 | 7/1968 | Joa . | |
| 3,469,836 | 9/1969 | Javid | 271/199 |
| 3,885,664 | 5/1975 | Fujimura | 271/184 |
| 4,166,525 | 9/1979 | Bruno . | |
| 4,691,912 | 9/1987 | Gillmann | 271/265 |
| 4,693,464 | 9/1987 | Honma | 271/265 |
| 4,972,236 | 11/1990 | Hasegawa | 271/291 |

FOREIGN PATENT DOCUMENTS

| | | | |
|---|---|---|---|
| 1010015 | 6/1957 | Germany . | |
| 1060792 | 7/1959 | Germany . | |
| 1199189 | 3/1966 | Germany . | |
| 6921932 | 5/1969 | Germany . | |
| 1556766 | 2/1970 | Germany . | |
| 2251000 | 6/1981 | Germany . | |
| 3319220 | 12/1983 | Germany . | |
| 3244400 | 10/1990 | Germany . | |
| 9106030 | 10/1992 | Germany . | |
| 0228346 | 11/1985 | Japan | 271/225 |
| 0028156 | 1/1989 | Japan | 271/225 |

*Primary Examiner*—H. Grant Skaggs
*Attorney, Agent, or Firm*—Spencer, Frank & Schneider

[57] ABSTRACT

An apparatus for reversing an orientation of flat items includes a first conveyor driven with a first speed; a second conveyor adjoining the first conveyor such that items discharged by the first conveyor are introduced into the second conveyor; a third conveyor driven with a second speed and adjoining the second conveyor such that items discharged by the second conveyor are introduced into the third conveyor; a sensor for determining a moment when a trailing edge of an item leaves the first conveyor; and a control arrangement connected to the sensor and the second conveyor for driving the second conveyor with the first speed as an item enters the second conveyor from the first conveyor, for decelerating the second conveyor when the sensor determines the moment when a trailing item edge passes by, for reversing a direction of motion of the second conveyor after deceleration and for accelerating the second conveyor to the second speed as an item enters the third conveyor from the second conveyor.

12 Claims, 2 Drawing Sheets

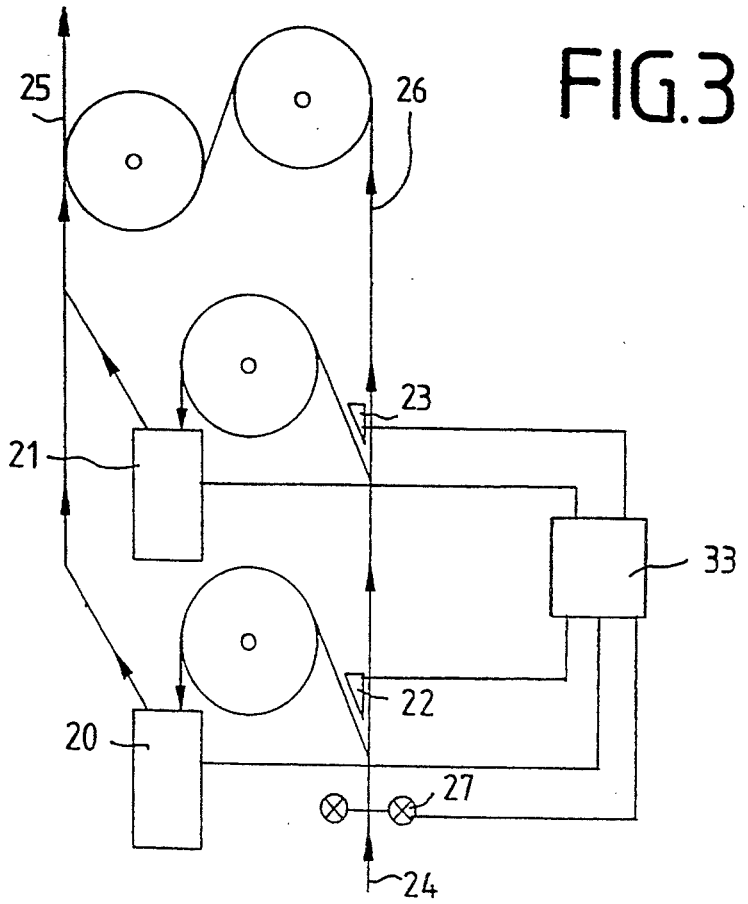
FIG.3
FIG.4a
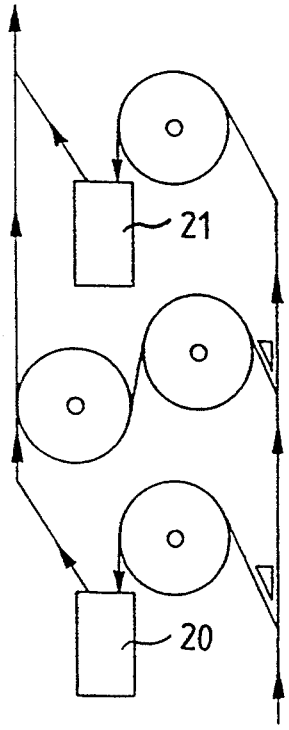
FIG.4b
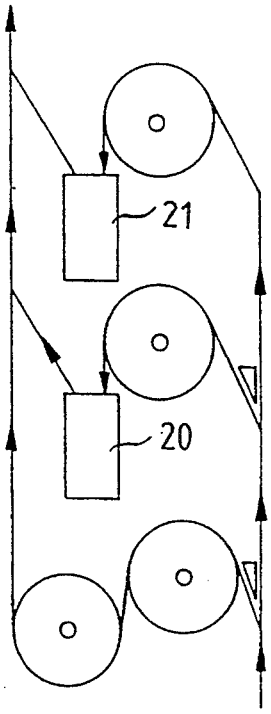
FIG.4c
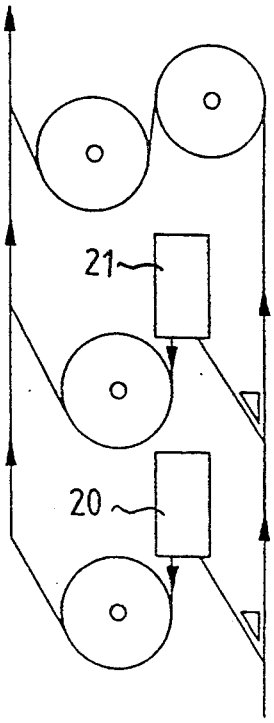

APPARATUS FOR REVERSING THE DIRECTION OF FLAT ITEMS

CROSS REFERENCE TO RELATED APPLICATION

This application claims the priority of German Application No. P 43 15 053.5 filed May 6, 1993, which is incorporated herein by reference.

BACKGROUND OF THE INVENTION

The present invention relates to an apparatus for reversing the direction (orientation) of flat items for mail-sorting systems.

In mail-sorting systems, flat items are typically supplied to mark recognition or identification devices that allow the distribution of the items according to the different information written on the surface thereof. In such conventional systems the problem arises that a portion of the items are transported in the conveyor means in such a way that the item surface provided with the necessary information is not in the processing position (that is, in a position that allows processing by the mark recognition device). An item not located in the processing position can be brought into the processing position by being rotated about its longitudinal and/or vertical axis. Because of such rotations the clearance between the items changes, possibly even resulting in overlapping of the items, which can lead to jams and functional breakdowns of the system.

SUMMARY OF THE INVENTION

It is an object of the present invention to provide an apparatus with which items can be rotated quickly and reliably about their vertical axis, that is, the axis perpendicular to and passing through the largest plane defined by each of the flat items.

A further object of the invention is to provide an apparatus with which the rotation of items around their vertical axis takes place in such a way that the clearances between the items are identical prior to and following rotation.

These objects and others to become apparent as the specification progresses, are accomplished by the invention, according to which, briefly stated, the apparatus for reversing an orientation of flat items includes a first conveyor driven with a first speed; a second conveyor adjoining the first conveyor such that items discharged by the first conveyor are introduced into the second conveyor; a third conveyor driven with a second speed and adjoining the second conveyor such that items discharged by the second conveyor are introduced into the third conveyor; a sensor for determining a moment when a trailing edge of an item leaves the first conveyor; and a control arrangement connected to the sensor and the second conveyor for driving the second conveyor with the first speed as an item enters the second conveyor from the first conveyor, for decelerating the second conveyor when the sensor determines the moment when a trailing item edge passes by, for reversing a direction of motion of the second conveyor after deceleration and for accelerating the second conveyor to the second speed as an item enters the third conveyor from the second conveyor.

Thus, the direction reversing apparatus is effective for reversing a direction of each of the items by interchanging the front edge of a given items with the rear edge of that item.

It is a particularly advantageous feature of the invention that the items are guided inside the device reliably and without jars and shocks. Moreover, the items are continuously frictionally gripped in a force transmitting relation within the device and are thus never permitted to move freely therein. As a result of this last measure, high precision in the control of the movement of the items is achieved, and disturbances in item travel are avoided. The device slows and accelerates the items in a gentle manner, and it also permits the return of an item into its original space in the item flow.

BRIEF DESCRIPTION OF THE DRAWINGS

FIG. 3 is a schematic illustration of a combination of two direction reversing apparatus in accordance with the invention.

FIGS. 4*a*, 4*b* and 4*c* are schematic illustrations similar to FIG. 3, showing additional embodiments as variations of the combination of FIG. 3.

DETAILED DESCRIPTION OF THE PREFERRED EMBODIMENTS

Figure 1:
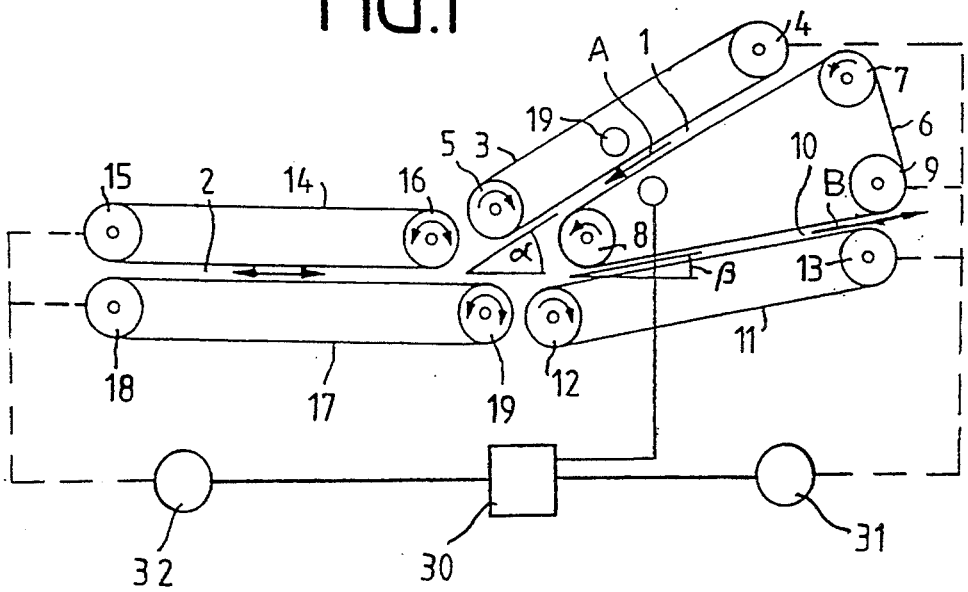
FIG. 1 is a schematic side elevational view of a preferred embodiment of a direction reversing apparatus according to the invention.

In the device shown in its principal design in FIG. 1, the items to be rotated are supplied to a first conveyor channel 1 and therefrom in the direction of the arrow A to a second conveyor channel 2. The first conveyor channel 1 is defined on one side thereof by a run of a conveyor belt 3 driven by two guiding rollers 4 and 5, and on another side thereof by a run of a further conveyor belt 6 driven by guiding rollers 7, 8 and 9. Conveyor channel 1 thus constitutes a first conveying means for the item. The, channel-forming runs of the two conveyor belts 3 and 6 are disposed parallel to one another such that they form the narrow conveyor channel 1 in which an item to be transported is guided and advanced by the belts 3 and 6 which are in frictional force-transmitting contact with opposite item surfaces. A third conveyor channel 10, defined on one side thereof by a run of conveyor belt 6 and on another side thereof by a run of a conveyor belt 11, driven by guiding rollers 12 and 13, receive items from the second conveyor channel 2 which is defined by runs of conveyor belts 14 and 17 driven by guiding rollers 15, 16, and 18, 19, respectively. Conveyor channel 2 and conveyor channel 10 thus constitute a second and third conveying means, respectively. The items are guided within each conveyor channel 1, 2 and 10 by being frictionally gripped on opposite faces by the respective belt runs.

An item to be reversed by the apparatus is supplied to conveyor channel 2 by conveyor channel 1 at a predetermined, preferably constant velocity. The belts 14, 17 defining conveyor channel 2 are controlled and, at the moment of transfer, move in the same direction and at the same velocity as the belts 3, 6 of conveyor channel 1. The item is therefore received within channel 2 reliably and without jars or shocks. As soon as the rear item edge has left conveyor channel 1, the item is slowed by conveyor belts 14 and 17. The velocity of the conveyor belts 14 and 17 is controlled according to a predetermined reversal velocity profile. After the item has been decelerated, the conveying direction is reversed and the item is accelerated to a second predetermined reversal velocity in accordance with the predetermined velocity profile. Thereafter, the items are received by the third conveyor channel 10 from the second conveyor channel 2, that is, in between conveyor belts 6 and 11 which move the items at the second predetermined velocity in the direction of arrow B in order to assure an impact-free and reliable transfer thereof into channel 10. The point in time when the rear item edge leaves first conveyor channel 1 is preferably detected by a light detection device (optical barrier) 19 coupled to a control device 30 which may include a computer in which the velocity course (profiles) are programmed. The device 30 is connected to a motor 31 which operates conveyor belts 3, 6, 11 and a motor 32 which operates conveyor belts 14, 17.

In the embodiment of the device according to FIG. 1, the conveying directions in conveyor channels 1 and 2 form an angle $\alpha$, and the conveying directions in conveyor channels 2 and 10 together form an angle $\beta$ which is smaller than angle $\alpha$. During the transfer of the items to either conveyor channel 2 or conveyor channel 10, the items are first moved in these channels in the direction in which they were being moved in the previous conveyor channel. It is thus ensured that an item can be reliably guided out of conveyor channel 1 into conveyor channel 2, or out of conveyor channel 2 into conveyor channel 10 without necessitating additional measures for influencing the direction of the items, such as deflector plates or the like. It is noted, however, that the invention may be practiced with the use of such additional measures as well.

Thus, to assure reliable guidance of the items, two controlled conveyor belts 14 and 17 are used to define conveyor channel 2. However, one of the two controlled belts can also be replaced with a single conveyor roller or a plurality of serially arranged conveyor rollers without a fundamental change in function. It is also possible in principle to replace both controlled belts with two controlled conveyor rollers or two series of such rollers between which the item to be reversed is guided.

Figure 2:
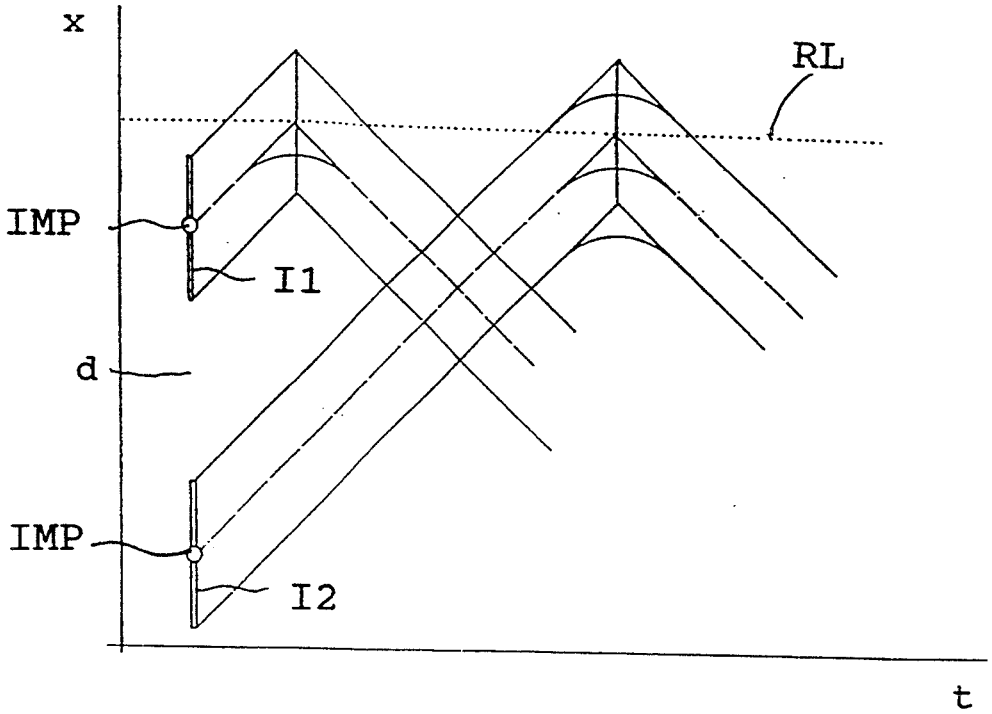
FIG. 2 is a path-time diagram showing the respective position/time graphs of two successive items whose directions are to be reversed.

FIG. 2 shows a path/time diagram for two successive items whose directions are to be reversed. In this instance the dashed line indicates the idealized position versus time graph of the item mid-point. The vertical axis corresponds to the location x of items I1 and I2, and the horizontal line RL corresponds to a theoretical reversal line of the items, which are separated by a gap d. The midpoint of each of the items is indicated by IMP. An impact-free reversal of two items in the device as shown in FIG. 2 requires that the reversed item is already outside the reversing mechanism comprising belts 14 and 17 before the second item enters therein. Because of the high conveying velocities conventionally used today, this may lead to an excessive required minimum gap between successive items.

FIG. 3 shows an embodiment with which successive items may be reversed while keeping a significantly smaller gap between items than is feasible with the earlier-described embodiment shown in FIG. 1. In the FIG. 3 embodiment, two reversing units 20 and 21 are used, each being constructed, for example, in accordance with the embodiment shown in FIG. 1. The items are advanced on an inlet conveyor (track) 24 from which, by means of a switch 22, items may be selectively directed to the first reversing unit 20 (that is, introduced into the conveyor channel 1 thereof). Other items proceed on the continuation of the inlet conveyor 24 where, downstream of the switch 22 a further switch 23 is provided by means of which items may be selectively directed to the second reversing unit 21. Other items continue on a delaying conveyor (track) 26. The outlet of the first reversing unit 20 and the second reversing unit 21 as well as the delaying conveyor 26 merge at different locations in an outlet conveyor (track) 25. A sensor 27 situated upstream of the switch 22 in the inlet conveyor 24 determines the spacing between consecutive items and also determines whether the item is properly aligned for address-reading in the processing position or whether its position should be corrected by the reversing arrangement. Thus, items which need not be reversed circumvent the first and second reversing units 20, 21. A control device 33 coupled to the switches 22, 23, to the sensor 27 as well as to the first and second reversing units 20 and 21 directs the items to be reversed alternatingly into the first and the second reversing units 20, 21 or forwards the other items through the delaying track 26 to the outlet conveyor 25. Also, as a function of the signals received from the sensor 27, the control device 33 ensures that the spacing of the items in the outlet conveyor 25 will be the same as in the inlet conveyor 24. Thus, items to be reversed travel out of the reversing unit 20 or 21 backward with respect to their prior orientation; the former rear edge of each item thus becomes its new front edge. The flow of reversed items then rejoins the unreversed items in outlet conveyor 25. If the gap between two items to be transported to the same reversing device is too small, an impact between the items can be avoided by moving the second item to the delay conveyor 25 and separating it out later.

FIGS. 4*a* through 4*c* show further advantageous embodiments of the combination of two reversing units 20 and 21. Instead of providing three paths defined by reversing units 20, 21 and delaying conveyor 26, a straight path (without reversal) can also be followed through units 20 and 21 and these two item flows can join the reversed flows after suitable deviation.

In present-day mail-sorting systems it is conventional to provide constant gaps between the items of an item flow to be processed. To make it possible for an item to return into its original space after its direction is reversed, the mid-points of the adjacent items must be relatively in the same position with respect to one another and have the same velocity after leaving the reversing apparatus. This can be realized with very different velocity profiles of the items inside the reversing apparatus. FIG. 2 shows by way of an example a possible course in time of the location of the item mid-point inside the reversing apparatus.

In one embodiment of the invention, in accordance with FIG. 1, the exact velocity profile of the belt movement in the reversing mechanism is determined as a function of the item length, the belt velocity in the rest of the system, and the time at which the rear edge of an item exits from conveyor channel 1, which time is detected by light detection device 19. The determination of this velocity profile is preferably done on-line by a processor. The calculated course of the belt movement then serves as a nominal value for the cascade control of the setting drive for conveyor channel 2. It is therefore possible to accurately reposition into the item flow those items which, because of disturbances, previously shifted slightly in the item flow. In this manner gap corrections may be effected.

It will be understood that the above description of the present invention is susceptible to various modifications, changes and adaptations, and the same are intended to be comprehended within the meaning and range of equivalents of the appended claims.

What is claimed is:

1. An apparatus for reversing an orientation of flat items, comprising (a) a first conveyor defining a first conveying direction and having an outlet;

(b) a second conveyor defining a second conveying direction, said second conveyor adjoining said first conveyor and having an end constituting an item inlet and an item outlet; said end of said second conveyor being aligned with said outlet of said first conveyor such that items discharged through said outlet are introduced into said second conveyor through said end thereof;

(c) a third conveyor defining a third conveying direction and adjoining said second conveyor; said third conveyor having an inlet; said inlet of said third conveyor being aligned with said end of said second conveyor such that items discharged through said end of said second conveyor are introduced into said third conveyor through said inlet thereof;

(d) drive means for driving said first conveyor with a first speed and for driving said third conveyor with a second speed;

(e) sensor means for determining a moment when a trailing edge of an item leaves said first conveyor through said outlet thereof; and (f) control means connected to said sensor means and said second conveyor for driving said second conveyor with said first speed as an item enters said second conveyor from said first conveyor, for decelerating said second conveyor when said sensor means determines said moment, for reversing a direction of motion of said second conveyor after deceleration and for accelerating said second conveyor to said second speed as an item enters said third conveyor from said second conveyor.

2. The apparatus as defined in claim 1, wherein said first, second and third conveyors include means for continuously exerting item-advancing forces to opposite faces of said items.

3. The apparatus as defined in claim 1, wherein at least one of said first, second and third conveyors includes first and second endless conveyor belts each supported by rollers; each conveyor belt having a working run; the working runs extending parallel to one another; the working run of said first conveyor belt and the working run of said second conveyor belt together defining a conveyor channel in which the items are advanced while frictionally engaging said working runs.

4. The apparatus as defined in claim 1, wherein said sensor means comprises an optical barrier.

5. The apparatus as defined in claim 1, wherein said first and third conveyors are formed together by a first, second and third endless conveyor belt each supported by rollers; the first conveyor belt having a first-working run, the second conveyor belt having a second and a third working run and the third conveyor belt having a fourth working run; said first and second working runs together defining a conveyor channel of said first conveyor and said third and fourth working runs together defining a conveyor channel of said third conveyor.

6. The apparatus as defined in claim 5, wherein said second conveyor is formed together by a fourth and fifth endless conveyor belt each supported by rollers; a working run of the fourth conveyor belt and a working run of the fifth conveyor belt together defining a conveyor channel of said second conveyor.

7. The apparatus according to claim 5, said first conveying direction and said second conveying direction together defining an acute angle $\alpha$; said second conveying direction and said third conveying direction together defining an acute angle $\beta$; the angle $\beta$ being less than the angle $\alpha$; said rollers including a first, a second and a third roller supporting said first, said second and said third endless conveyor belt, respectively, in a region of said outlet of said first conveyor and said inlet of said third conveyor; said first, second and third rollers being staggered with respect to one another.

8. The apparatus as defined in claim 1, wherein said second conveyor is formed by an endless conveyor belt and by at least one conveyor roller defining a conveyor channel with a working run of said conveyor belt; said endless conveyor belt being supported by belt-deflecting rollers.

9. The apparatus according to claim 1, wherein: said first conveying direction and said second conveying direction together define an acute angle $\alpha$; and said second conveying direction and said third conveying direction together define an acute angle $\beta$, the angle $\beta$ being less than the angle $\alpha$.

10. An apparatus for reversing an orientation of flat items, comprising (a) first and second reversing units; each said reversing unit including (1) a first conveyor having an outlet;

(2) a second conveyor having an end constituting an item inlet and an item outlet; said end being aligned with said outlet of said first conveyor such that items discharged through said outlet are introduced into said second conveyor through said end thereof;

(3) a third conveyor adjoining said second conveyor; said third conveyor having an inlet; said inlet of said third conveyor being aligned with said end of said second conveyor such that items discharged through said end of said second conveyor are introduced into said third conveyor through said inlet thereof;

(4) drive means for driving said first conveyor with a first speed and for driving said third conveyor with a second speed; and (5) sensor means for determining a moment when a trailing edge of an item leaves said first conveyor through said outlet thereof;

(b) an inlet track; said first and second reversing units branching from said inlet track;

(c) a first switch in said inlet track for selectively directing items from said inlet track to said first reversing unit or to a continuation of said inlet track;

(d) a delaying track connected end-to-end to said continuation of said inlet track;

(e) a second switch in said continuation of said inlet track for selectively directing items from said continuation of said inlet track to said second reversing unit or to said delaying track;

(f) an outlet track operatively connected to said first and second reversing units and to said delaying track for receiving items from said first and second reversing units and from said delaying track; and (g) control means for driving each said second conveyor with said first speed as an item enters said second conveyor from said first conveyor, for decelerating the second conveyor when said sensor means determines said moment, for reversing a direction of motion of said second conveyor after deceleration, for accelerating said second conveyor to said second speed as an item enters said third conveyor from said second conveyor and for operating said first and second switches.

11. An apparatus as defined in claim 10, wherein said first, second and third conveyors include means for continuously exerting item-advancing forces to opposite faces of said items.

12. The apparatus as defined in claim 10, further comprising an additional sensor means for determining a spacing between successive items on said inlet conveyor upstream of said first switch; said additional sensor means being connected to said control means.

* * * * *